United States Patent [19]

Johannes

[11] 3,994,642

[45] Nov. 30, 1976

[54] ROTARY PISTON INTERNAL COMBUSTION ENGINE OF THE TROCHOIDAL TYPE

[75] Inventor: Steinwart Johannes, Obersulm-Willsbach, Germany

[73] Assignee: Audi NSU Auto Union Aktiengesellschaft, Neckarsulm, Germany

[22] Filed: Jan. 7, 1976

[21] Appl. No.: 646,953

[30] Foreign Application Priority Data

Jan. 11, 1975 Germany ..... 2500957

[52] U.S. Cl. ..... 418/99; 418/100

[51] Int. Cl.² ..... F01C 21/04

[58] Field of Search ..... 123/8.01, 196 R; 184/55 R; 418/83, 84, 87, 97, 99, 100

[56] References Cited

UNITED STATES PATENTS

| | | | |
|---|---|---|---|
| 3,213,837 | 10/1965 | Keylwert | 418/99 X |
| 3,771,903 | 11/1973 | King et al. | 418/94 X |
| 3,838,950 | 10/1974 | Andriulis | 418/97 X |
| 3,904,329 | 9/1975 | Steinwart | 418/99 |
| 3,923,435 | 12/1975 | Jones | 418/100 |

*Primary Examiner*—Carlton R. Croyle
*Assistant Examiner*—Michael Koczo, Jr.
*Attorney, Agent, or Firm*—Kane, Dalsimer, Kane, Sullivan and Kurucz

[57] ABSTRACT

A rotary piston internal combustion engine of the trochoidal type with a housing. The engine includes at least one peripheral wall portion and at least two parallel side portions and has induction and exhaust ports. Each peripheral wall portion and two associated side portions define a cavity in which a multi-apex piston is rotatably mounted to define variable volume working chambers. The piston is provided with seal elements which are in sliding engagement with the inner surfaces of the housing. The seal elements are provided with a passage for lubricating the inner surfaces of the housing with the passage opening into the cavity in the neighborhood of each induction port in the region of that working chamber which is undergoing the induction phase. The passage is in communication with the atmosphere and has a lubricant feed pipe opening into it. A restriction is provided in the passage between its point of entry into the cavity and the point of entry of the lubricant feed pipe. The restriction has a cross sectional area for a flow of a maximum of about 30% of the idling air consumption of the engine. The point of entry of the passage into the cavity is arranged so that it is cut off by the piston at the latest at the instant of closing of the induction port or ports by the working chamber that is undergoing the induction phase.

3 Claims, 2 Drawing Figures

ROTARY PISTON INTERNAL COMBUSTION ENGINE OF THE TROCHOIDAL TYPE

BACKGROUND OF THE INVENTION

The invention relates to a rotary piston internal combustion engine of the trochoidal type with a housing which comprises at least one peripheral wall portion and at least two parallel side portions and has induction and exhaust ports. Each peripheral wall portion and two associated side portions defines a cavity in which a muli-apex piston is rotatably mounted to define variable volume working chambers. The piston is provided with seal elements which are in sliding engagement with the inner surfaces of the housing. A passage is provided in the housing for lubricating these inner surfaces. The passage opens into the cavity in the neighbourhood of each induction port in the region of that working chamber which is undergoing the induction phase. The passage is in communication with the atmosphere and a lubricant feed pump opens into the passage.

One known engine of the this type is present in British Patent No. 1,422,087. In that engine, a uniformly dosed supply of lubricant to the inner surfaces of the housing and to the seal elements that are in sliding contact with it is achieved by arranging that the lubricant entering the passage is picked up by the air flow past it. As a consequence of its adhesion, the walls of the passage are coated with a film of lubricant which is uniformly driven forwards into the working chamber. The passage in this arrangement has a special variable air-throttling device which is coupled to the throttle valve of the engine and which, when the throttle valve is closed, uncovers a small cross sectional area and with progressive opening of the throttle valve it uncovers a progressively greater cross sectional area. The degree of effectiveness of the air stream in driving the lubricant forward can thereby be increased or decreased according to the position of the engine throttle. Thereby a corresponding quantity of lubricant, delivered for example from a metering pump, is driven forward to a greater or lesser extent, and also the danger is avoided of a substantial quantity of lubricant entering the chamber suddenly and being burnt up unused. A non-return valve is provided in the lubricant feed pipe so that the lubricant feed pipe that opens into the passage is not sucked dry by high vacuum prevailing in the working chamber and so that the subsequent supply of lubricant cannot be interrupted. It is true that this arrangement does ensure correct lubrication of the sealing elements to match the prevailing working conditions, however, there is a constant need in the art for improvement in lowering the equipment costs for the type of system under consideration.

SUMMARY OF THE INVENTION

With the above background in mind, it is among the primary objectives of the present invention to provide a rotary piston internal combustion engine of the type described above, in which the lubrication of the seal elements can be achieved in a significantly simple and inexpensive manner.

This objective is achieved by providing a restriction in the passage between its point of entry into the cavity and the point of entry of the lubricant feed pipe. The restriction has a cross sectional area for the flow of a maximum of about 30% of the quantity idling air consumption of the engine. The point of entry of the passage into the cavity is arranged so that it is closed off by the piston at the latest at the instant of closing of the induction port or ports by the working chamber that is undergoing the induction phase.

In contrast to a specially provided variable air-throttling device, the restriction provides a path which is permanently open and is preferably of such dimensions that the extra air drawn in by the engine through this restriction cannot have any adverse influence at any part of the load range, especially under idling conditions. Thus at the restriction there is an air flow which varies automatically according to the load on the engine and the required dosage of lubricant for the engine, fed in with the flow of air, is thereby automatically adjusted so there is no need for any separate regulation of the air flow in the passage in the form of a variable air-throttling device. By virture of the restriction which is proposed and which can be arranged very close to the working chamber undergoing the induction phase, in contrast to the arrangement of an air-throttling device the pressure relationships prevailing in the working chamber also largely prevail between the point of entry of the passage into the working chamber and the restriction, while beyond, that is in the zone upstream of this restriction and therefore in the passage between the restriction and the connection to atmosphere, into which the lubricant feed pipe opens, there are no significant variations in pressure. For this reason the lubricant feed pipe opening into the last mentioned zone likewise is not subject to influence from pressure or suction so that the lubricant which, for example, is fed from a lubricant metering pump at zero pressure, can flow into the passage without any back pressure and, as a further advantage, the provision of a non-return valve at the point of entry of the lubricant feed pipe is unnecessary. The lubricant entering the passage can coat the wall of the passage, as a result of the air flowing past, and is then driven in the form of an oil film to the restriction and from there by virtue of the velocity of the air stream which is effective at this point, it is driven into the cavity, achieving effective lubrication of the seal elements.

The portion of the passage between the point of entry into the working chamber and the restriction can, in a known manner, be formed by an axially disposed bore within the peripheral wall portion parallel to the running surface, this bore being in communication with the cavity through troughs or recesses provided in the adjacent side walls. Thereby the oil driven into the cavity by the air stream can reach both the side walls and also the running surface of the peripheral wall so that simultaneously the axial and radial seal elements of the piston are supplied with lubricant.

In order to maintain at least largely the flow velocity of the air stream caused by the restriction and thereby to achieve a rapid onward feed of the lubricant into the cavity, a pin can be located in the bore, to reduce the cross section of the bore and can be bent to jam in place.

As well as assuring trouble-free supply of the seal elements to be lubricated in accordance with the prevailing load on the engine, the construction proposed has the advantage that both the variable air-throttling device comprising a number of individual components and the non-return valve of the known construction can be eliminated and accordingly the construction can be achieved with a minimum outlay and a significantly lower cost.

Further details and features of the invention are revealed by the following description in conjunction with the accompanying drawings in which is illustrated an embodiment of the invention by way of example.

DESCRIPTION OF THE PREFERRED EMBODIMENT

Figure 1:
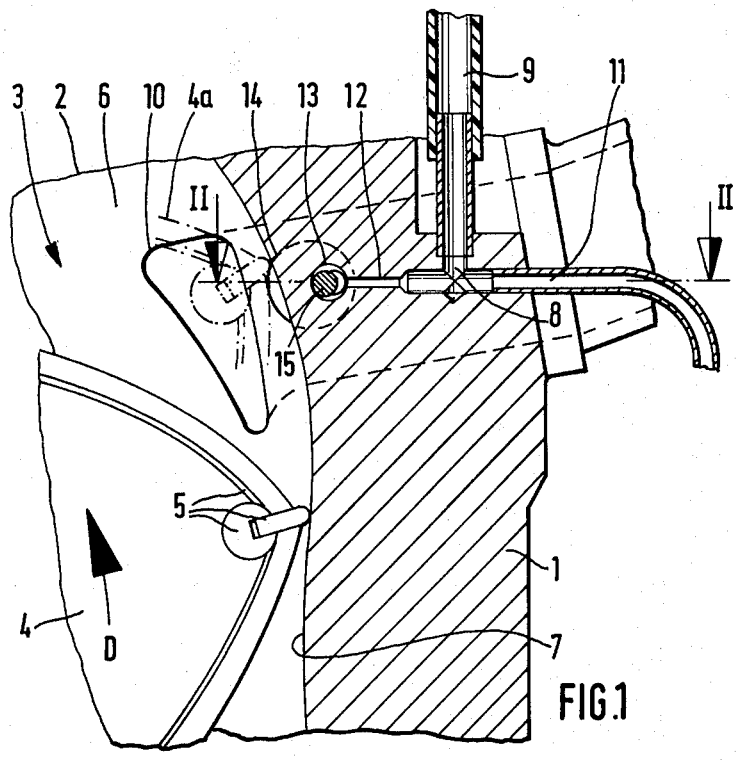
FIG. 1 is a cross section through part of the housing of a rotary piston internal combustion engine.

In reference first to FIG. 1, in which the housing of a rotary piston internal combustion engine comprises a peripheral wall portion 1 and parallel side walls 2 and defines a cavity 3 in which a multi-apex piston 4 is rotatably mounted to define variable volume working chambers, the piston being provided with seal elements 5 which are in sliding engagement with the inner surfaces of the housing, these surfaces being formed by the side walls 6 of the side portions 2 and by the running surface 7 of the peripheral wall portion. To lubricate the inner surfaces there is provided a passage 8 which on the one hand is in permanent communication with atmosphere, preferably through an air filter (not shown), through an air inlet 9 and on the other hand is in communication with the cavity 3 in the neighbourhood of the induction port 10. Between a lubricant feed pipe 11 which opens into the passage 8 and the point of entry of the passage 8 into the cavity 3 there is a restriction 12 which has a cross sectional area for flow designed for a maximum of about 30% of the idling air consumption of the engine, the quantity of air reaching the cavity 3 through the passage 8 being capable of being set by adjustment of the usual idling mixture device to the ratio necessary for operation. In one particular chosen size of engine the diameter of the restriction 12 is between 2 and 2.5 mm and its length is about 10 mm.

Figure 2:
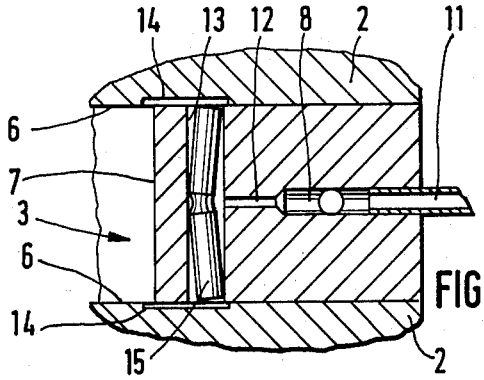
FIG. 2 is a longitudinal section through the peripheral wall portion and adjacent side portions on the line II—II in FIG. 1.

As also seen in FIG. 2, in this embodiment by way of example the restriction 12 is followed, looked at in the direction of flow, by a bore 13 which is arranged to extend axially and parallel to the running surface 7 of the peripheral wall portion and within this portion 1, this bore being in communication with the cavity 3 through troughs or recesses 14 provided in the adjacent side walls 6. The point of entry of the passage 8 formed by the troughs 14 is arranged here in such a manner that it is cut off from the working chamber undergoing the induction phase by the piston 4 rotating in the direction D at the latest at the instant of closing of the induction port 10, which corresponds to the position **4*a* of the piston 4 indicated in broken lines in FIG. 1. By this arrangement of the troughs 14 under the control of the working chamber undergoing the induction phase the flow of air in the passage 8 is always directed towards the cavity 3.**

In the operation of the engine a lubricant metering pump (not shown), delivers lubricant through the pipe 11 to the passage 8. The flow of air in the passage 8 resulting from the vacuum in the working chamber which is undergoing the induction phase picks up this lubricant and drives it along the wall of the passage 8 to the restriction 12 from which it is rapidly picked up as a result of the increased velocity of the air caused by the reduction in cross section. In order to maintain substantially the high velocity of flow arising at the restriction 12 a pin 15 is pressed into the bore 13, this pin having a cross section which (simply by it having a large diameter) narrows down the bore 13 and thereby ensures that the lubricant picked up by the air flow can pass without delay into the cavity 3 to lubricate the seal elements 5. The pin 15 is bent at its mid-point so that it can be jammed to prevent it moving the bore 12. The constriction provided at the midpoint of the pin prevents the restriction 12 being obstructed.

As the lubricant, as a consequence of its adhesive tendency, is driven forward predominantly as a film of lubricant on the walls of the passage 8, the restriction 12 and the bore 13, it can reach both the axial and the radial sealing elements 5 of the piston 4, through the lateral troughs 14, ensuring reliable lubrication of the seal elements.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A rotary piston internal combustion engine of the trochoidal type with a housing comprising: at least one peripheral wall portion and at least two parallel side portions and having induction and exhaust ports, each peripheral wall portion and two associated side portions defining a cavity in which a multi-apex piston is rotatably mounted to define variable volume working chambers, the piston being provided with seal elements which are in sliding engagement with the inner surfaces of the housing, and in which, for lubricating these inner surfaces, there is provided a passage which opens into the cavity in the neighbourhood of each induction port in the region of that working chamber which is undergoing the induction phase, which passage is in communication with the atmosphere and into which passage there opens a lubricant feed pipe, a restriction provided in the passage between its point of entry into the cavity and the point of entry of the lubricant feed pipe, the restriction having a cross sectional area for a flow of a maximum of about 30% of the idling air consumption of the engine, the point of entry of the passage into the cavity being arranged so that it is cut off by the piston at the latest at the instant of closing each induction port by the working chamber that is undergoing the induction phase.

2. A rotary piston internal combustion engine according to claim 1 in which the portion of the passage between the point of entry into the cavity and the restriction is formed by an axially extending bore within the peripheral wall portion parallel to its running surface, this bore being in communication with the cavity through troughs or recesses provided in the adjacent side portions.

3. A rotary piston internal combustion engine according to claim 1 in which a pin is located in the bore to reduce the cross section of the bore.

* * * * *